US010515752B2

(12) United States Patent
Choi et al.

(10) Patent No.: US 10,515,752 B2
(45) Date of Patent: Dec. 24, 2019

(54) THIN FILM INDUCTOR AND MANUFACTURING METHOD THEREOF

(71) Applicant: SAMSUNG ELECTRO-MECHANICS CO., LTD., Suwon-si, Gyeonggi-do (KR)

(72) Inventors: Woon Chul Choi, Suwon-si (KR); Ji Hye Oh, Suwon-si (KR); Sung Hee Kim, Suwon-si (KR); Jung Hyuk Jung, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 67 days.

(21) Appl. No.: 15/386,098

(22) Filed: Dec. 21, 2016

(65) Prior Publication Data

US 2017/0372832 A1 Dec. 28, 2017

(30) Foreign Application Priority Data

Jun. 24, 2016 (KR) ..... 10-2016-0079520

(51) Int. Cl.

| | |
|---|---|
| ***H01F 5/00*** | (2006.01) |
| ***H01F 27/28*** | (2006.01) |
| ***H01F 27/245*** | (2006.01) |
| ***H01F 27/32*** | (2006.01) |
| ***H01F 41/04*** | (2006.01) |
| ***H01F 41/12*** | (2006.01) |
| ***H01F 17/00*** | (2006.01) |
| ***H01F 17/04*** | (2006.01) |

(52) U.S. Cl.
CPC ..... *H01F 27/2804* (2013.01); *H01F 5/00* (2013.01); *H01F 17/0013* (2013.01); *H01F 17/04* (2013.01); *H01F 27/245* (2013.01); *H01F 27/323* (2013.01); *H01F 41/042* (2013.01); *H01F 41/046* (2013.01); *H01F 41/122* (2013.01); *H01F 2017/048* (2013.01); *H01F 2027/2809* (2013.01)

(58) Field of Classification Search
CPC ..... H01F 5/00; H01F 27/00–36
USPC ..... 336/65, 83, 200, 206–208, 232
See application file for complete search history.

(56) References Cited

U.S. PATENT DOCUMENTS

| | | | | |
|---|---|---|---|---|
| 9,595,384 | B2 * | 3/2017 | Nakamura | H01F 17/0013 |
| 2004/0164835 | A1 * | 8/2004 | Shoji | H01F 17/0013 336/200 |

(Continued)

FOREIGN PATENT DOCUMENTS

| | | | |
|---|---|---|---|
| JP | 2002-222725 | A | 8/2002 |
| KR | 10-2004-0086706 | A | 10/2004 |
| KR | 10-2015-0019588 | A | 2/2015 |

*Primary Examiner* — Tuyen T Nguyen
(74) *Attorney, Agent, or Firm* — Morgan, Lewis & Bockius LLP

(57) ABSTRACT

A thin film inductor includes a body including a coil part disposed therein, wherein the coil part includes a patterned insulating film disposed on a substrate and a coil pattern formed between the patterned insulating films, the coil pattern having a lower height than the insulating film, such that the coil pattern may be formed in a structure with a high aspect ratio while having a uniform thickness, thereby increasing a cross-sectional area of the coil part and improving direct current resistance (Rdc) characteristics.

7 Claims, 5 Drawing Sheets

(56) References Cited

U.S. PATENT DOCUMENTS

| | | | | |
|---|---|---|---|---|
| 2013/0222101 | A1* | 8/2013 | Ito | H01F 17/04 336/83 |
| 2013/0300527 | A1* | 11/2013 | Kim | H01F 41/046 336/83 |
| 2015/0048918 | A1 | 2/2015 | Park et al. | |

* cited by examiner

THIN FILM INDUCTOR AND MANUFACTURING METHOD THEREOF

CROSS-REFERENCE TO RELATED APPLICATION(S)

This application claims benefit of priority to Korean Patent Application No. 10-2016-0079520 filed on Jun. 24, 2016 in the Korean Intellectual Property Office, the disclosure of which is incorporated herein by reference in its entirety.

BACKGROUND

1. Field

The present disclosure relates to a thin film inductor and a manufacturing method thereof.

2. Description of Related Art

An inductor, which is an important passive element included in an electronic circuit, together with a resistor and a capacitor, is used in various systems and components, such as low-noise amplifiers, mixers, voltage control oscillators, matching coils, and the like.

A direct current (DC) resistance Rdc, one of the main characteristics of an inductor, decreases as a cross-sectional area of a coil pattern increases. In addition, as an area of a magnetic material through which magnetic fluxes pass increases, inductance of the inductor increases. Therefore, in order to decrease the direct current resistance (Rdc) and improve inductance, there is a need to increase the cross-sectional area of the coil pattern and increase the area of the magnetic material.

In order to increase the cross-sectional area of the coil pattern, the width of the coil pattern and/or the thickness of the coil pattern can be increased. However, increasing the width of the coil pattern significantly increases the risk of a short-circuit between adjacent coil patterns. There may also be a limitation in turns of the coil capable of being implemented in the inductor, which causes a decrease in the area of the magnetic material, such that efficiency may be decreased, which limits the ability to obtain high inductance.

Therefore, a thin film inductor having a structure with a high aspect ratio "AR," arrived at by increasing the thickness of the coil pattern, as compared to the width of the coil pattern, has been required.

The AR is a value obtained by dividing the thickness of the coil pattern by the width of the coil pattern. As the thickness of the coil becomes greater than the width of the coil, the implemented AR can be increased.

Korean Patent Laid-Open Publication No. 1004-0086706 and Korean Patent Laid-Open Publication No. 2015-0019588 relate to a thin film inductor.

SUMMARY

An aspect of the present disclosure may provide a thin film inductor capable of implementing low direct current resistance Rdc by forming coil patterns to have uniform thicknesses, and a manufacturing method thereof.

According to an aspect of the present disclosure, a thin film inductor may include: a body including a coil part disposed therein, wherein the coil part includes: a patterned insulating film disposed on a substrate; and a coil pattern formed between the patterned insulating films, the coil pattern having a lower height in the thickness direction than the insulating film.

According to another aspect of the present disclosure, a manufacturing method of a thin film inductor may include: patterning a first plating layer on a substrate; patterning an insulating film on the substrate so that the first plating layer is exposed; forming a second plating layer between the patterned insulating films by performing the plating based on the first plating layer to thereby obtain a coil pattern; and forming a body by stacking magnetic sheets on and below the substrate on which the insulating film and the first and second plating layers are formed, wherein the coil pattern has a lower height in the thickness direction than the insulating film.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

A thin film inductor, according to the present disclosure, will hereinafter be described.

Figure 1:
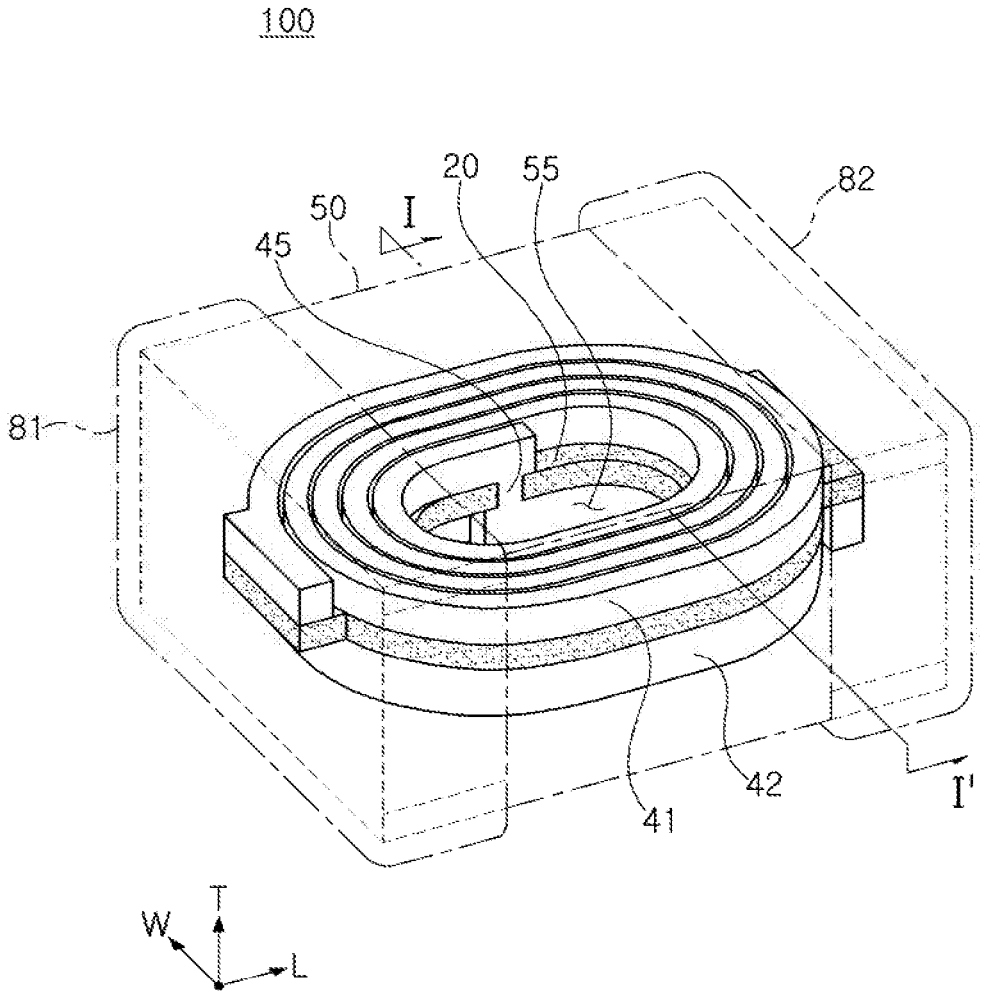
FIG. 1 is a schematic perspective view illustrating a thin film inductor including a coil part according to an exemplary embodiment in the present disclosure.
Figure 2:
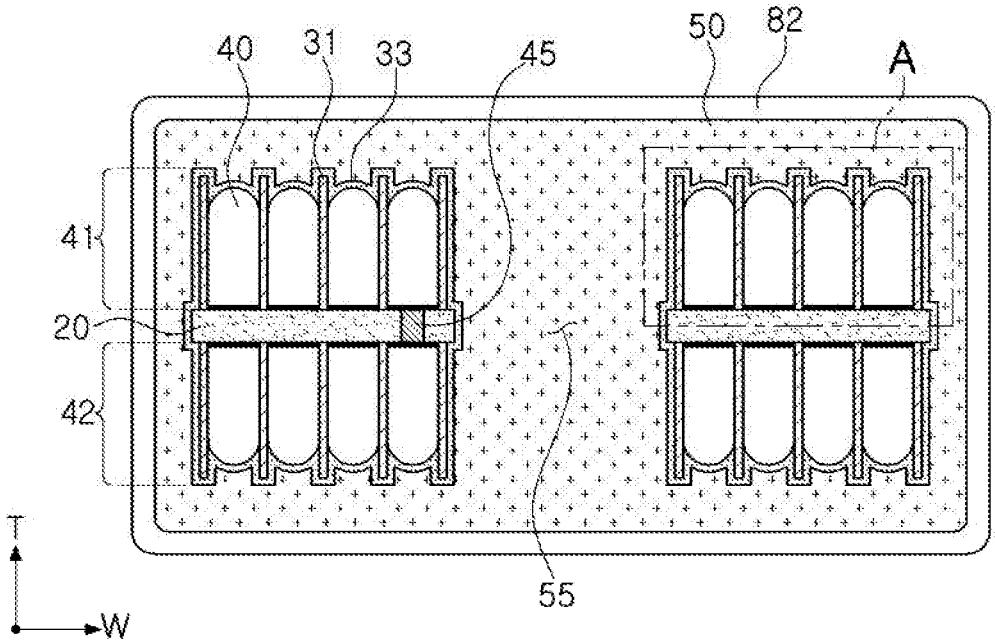
FIG. 2 is a cross-sectional view taken along line I-I' of FIG. 1.
Figure 3:
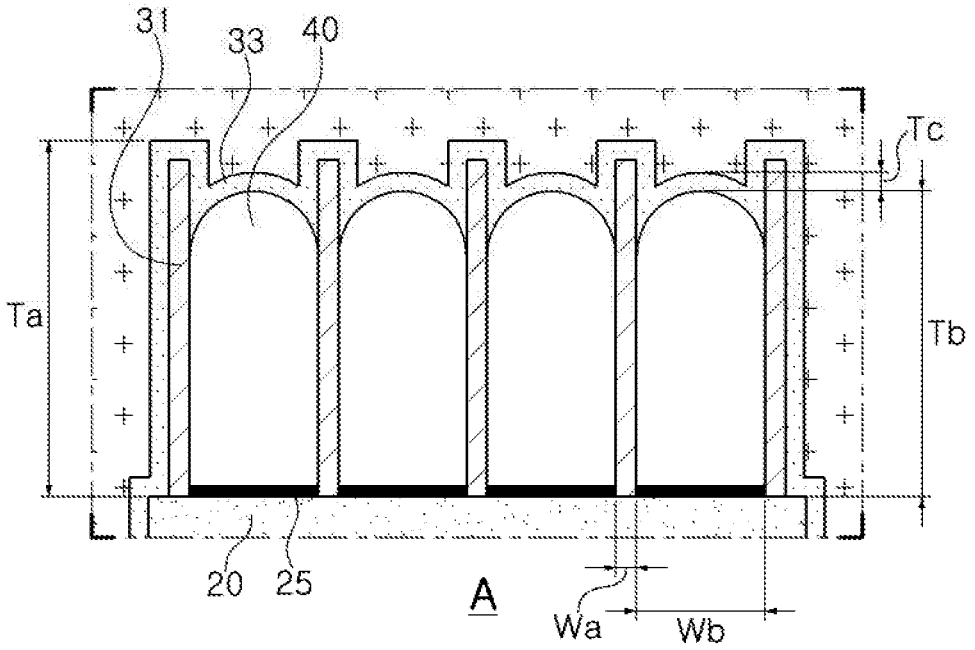
FIG. 3 is an enlarged schematic view of an example of part 'A' of FIG. 2.

FIG. 1 is a schematic cross-sectional view illustrating a thin film inductor including a coil part, according to an exemplary embodiment in the present disclosure. FIG. 2 is a cross-sectional view taken along line I-I' of FIG. 1. FIG. 3 is an enlarged schematic view of an example of part 'A' of FIG. 2.

Referring to FIG. 1, a thin film inductor 100 according to an exemplary embodiment in the present disclosure may include a body 50, coil parts 41 and 42 embedded in the body 50, and first and second external electrodes 81 and 82 disposed on an outer portion of the body 50 to thereby be electrically connected to the coil parts 41 and 42.

In the thin film inductor 100 according to the present exemplary embodiment, a "length" direction refers to an "L" direction of FIG. 1, a "width" direction refers to a "W" direction of FIG. 1, and a "thickness" direction refers to a "T" direction of FIG. 1.

The body 50 may form an exterior of the thin film inductor 100 and may be formed of a magnetic material.

The body 50 may contain any material as long as it exhibits magnetic properties. For example, the body 50 may contain ferrite or a metal magnetic powder.

The ferrite may be, for example, Mn—Zn-based ferrite, Ni—Zn-based ferrite, Ni—Zn—Cu-based ferrite, Mn—Mg-based ferrite, Ba-based ferrite, Li-based ferrite, or the like.

The metal magnetic powder may contain any one or more selected from the group consisting of Fe, Si, Cr, Al, and Ni. For example, the metal magnetic powder may be formed of a Fe—Si—B—Cr-based amorphous metal, but is not limited thereto.

The metal magnetic powder may have a particle diameter of 0.1 μm to 30 μm and may be contained in a form in which the metal magnetic powder is dispersed in a thermosetting resin such as an epoxy resin, polyimide, or the like.

The body 50 may include the coil part disposed in the body 50.

The coil part may include a substrate 20, a first coil part 41, including a coil pattern on one surface of the substrate 20, and a second coil part 42, including a coil pattern on the other surface of the substrate 20.

The substrate 20 may be, for example, a polypropylene glycol (PPG) substrate, a ferrite substrate, a metal-based soft magnetic substrate, or the like.

A central portion of the substrate 20 may be penetrated to thereby form a hole, and the hole may be filled with a magnetic material, thereby forming a core part 55. As the core part 55, filled with the magnetic material, is formed, inductance (Ls) may be improved.

Coil patterns may be formed in a spiral shape, and the coil patterns of the first and second coil parts 41 and 42 formed on opposing surfaces of the substrate 20 may be electrically connected to each other through a via 45 penetrating through the substrate 20.

The coil patterns and the via may contain a metal having excellent electric conductivity. For example, the coil patterns and the via may be formed of silver (Ag), palladium (Pd), aluminum (Al), nickel (Ni), titanium (Ti), gold (Au), copper (Cu), platinum (Pt), an alloy thereof, or the like.

The coil pattern may be formed by a plating method and may include a first plating layer 25 formed on the substrate, and a second plating layer 40 formed on the first plating layer by performing the plating on the first plating layer.

According to the related art, in a case of forming the coil pattern by using a pattern plating method of a plating resist through exposure and development processes and then plating, in order to form a thick coil pattern, the plating resist needs to be formed to be thick. However, in this case, it may be difficult to increase the thickness of the coil due to an exposure process limitation in which exposure of a lower portion of the plating resist is not smoothly performed as the thickness of the plating resist is increased.

Further, the plating resist has a predetermined width in order to maintain a shape thereof. However, since the width of the plating resist is equal to an interval between coils adjacent to each other after removing the plating resist, the interval between the coils adjacent to each other may be increased, which may limit improvements in direct current resistance (Rdc) and inductance (Ls) characteristics.

Generally, in order to form a coil part with a high AR, a method of performing anisotropic plating on a plating layer originally formed by isotropic plating has been carried out.

In the anisotropic plating method, a residual thickness of the coil pattern required after forming a seed pattern is implemented by anisotropic plating. When using this method, the coil pattern has a fan shape, and uniformity deteriorates, which may affect direct current resistance (Rdc) distribution.

Further, when using this method, since the shape of the coil may be bent, it may not be easy to form an insulating layer on the coil pattern, and thus non-insulation may occur in a space between the coil patterns, thereby causing a defect.

In the thin film inductor according to the exemplary embodiment in the present disclosure, an insulating film 31 patterned on the substrate may be formed such that a high AR may be implemented only by the isotropic plating method which a dispersion of thicknesses of the coil patterns is low.

Referring to FIGS. 2 and 3, the thin film inductor according to the exemplary embodiment in the present disclosure may include the body 50 with the coil parts 41 and 42 disposed therein, wherein the coil parts 41 and 42 may include the patterned insulating film 31 disposed on the substrate 20. The coil patterns made up of first and second plating layers 25 and 40 can be formed between patterned insulating films 31. Heights of the coil patterns may be lower than that of the insulating film 31.

The insulating film 31 may be disposed on the substrate 20 and formed by patterning.

The insulating film 31 may be patterned to be narrow and tall, thereby allowing the coil pattern to have a high AR, preventing the coil pattern from being bent, and decreasing defects caused by non-insulation in the space between the coil patterns.

The width "Wa" of the insulating film 31 may be 1 to 20 μm, and a thickness "Ta," that is, height in the thickness direction, of the insulating film 31 may be 200 μm or more.

The insulating film 31 may be formed of a material having insulating properties. For example, a filler may be used along with a polymer, photo-curable acrylate, or thermo-curable epoxy, or the like, in addition to the filler, but the material of the insulating film 31 is not limited thereto.

In addition, the insulating film 31 may be formed of a photo resist (PR) using an exposure and development method.

The coil patterns may be formed between the patterned insulating films 31. Therefore, defects due to a non-insulation region in the space between the coil patterns may be decreased.

A width "Wb" of the coil pattern may be 10 to 150 μm, and a thickness "Tb," that is, height in the thickness direction, of the coil pattern may be 200 μm or more.

The AR of the coil pattern may be 3.0 or more. The coil pattern may have a high AR, such that direct current resistance characteristics of a inductor may be improved.

The first and second plating layers 25 and 40 that make up the coil patterns may be formed by the isotropic plating method, and thus the coil patterns may have a rectangular shape.

In an isotropic plating method, the growth rates of the plating layer in the width and thickness directions are similar to each other. In an anisotropic plating method, the growth rates of the plating layer in the width and thickness directions differ from each other.

Where the coil pattern is formed by the isotropic plating method, a difference in thickness between an inner portion and an outer portion of the coil pattern may be decreased, in contrast to the anisotropic plating method, and a space between the coils may be guaranteed to be large, such that short-circuits may be decreased.

The coil patterns may include the first plating layer 25 formed on the substrate and the second plating layer 40 formed on the first plating layer 25.

The first plating layer 25 may serve as a seed layer for forming the second plating layer 40. The first plating layer may be formed by performing an electroless plating method or sputtering method on the substrate 20, forming a resist pattern, and etching and delaminating the resist pattern.

The width of the first plating layer may be 10 to 150 μm, but is not necessarily limited thereto.

The second plating layer 40 may be formed by the isotropic plating method in which a dispersion of thicknesses of the coil patterns is low, and may be formed by one iteration of a plating process.

The second plating layer may be a plating layer of which growth in the width direction is suppressed, and a degree of growth in the thickness direction is significantly large.

Since the second plating layer is formed between the patterned insulating films by the isotropic plating method, the second plating layer may have a rectangular shape, but the shape of the second plating layer may also be slightly changed by a variation in process.

Forming the second plating layer by one iteration of a plating process avoids creating additional internal interfaces that partition the plating layer into two more layers, which can occur when performing a plating process at least two times.

Such an internal interface may cause a deterioration in direct current resistance (Rdc) characteristics and electrical characteristics in the thin film inductor.

According to the exemplary embodiment in the present disclosure, since the second plating layer is formed by one iteration of a plating process, direct current resistance (Rdc) characteristics and electrical characteristics may be improved.

However, the second plating layer is not limited thereto, but may be composed of several plating layers.

Since the second plating layer 40 is formed by the isotropic plating method between the patterned insulating films, the second plating layer 40 may have a rectangular shape, but the shape of the second plating layer 40 may be slightly changed by a variation in process.

Referring to FIG. 3, the thickness Tb of the coil pattern may be smaller than the thickness Ta of the insulating film.

A difference between the thickness Tb of the coil pattern and the thickness Ta of the insulating film may be 40 μm or more.

Since the coil pattern has a smaller thickness, that is, height in the thickness direction, than that of the insulating film, a space may be formed between the insulating films and above the coil pattern.

The magnetic material of the body 50 may be filled in the space between the patterned insulating films and above the coil pattern.

According to the exemplary embodiment in the present disclosure, the body 50 may include a cover insulating layer 33, formed to enclose the coil parts 41 and 42 and the substrate 20. That is, the cover insulating layer 33 may be formed along surfaces of the substrate, the insulating film, and an outer surfaces of the coil patterns.

The cover insulating layer 33 and the insulating film 31 may be formed of different materials from each other.

Since the cover insulating layer 33 is formed on the surfaces of the patterned insulating film 31 and above the portions of the coil patterns between the patterned insulating films 31, the material and shape of the cover insulating layer 33 differ from those of the insulating film 31. As such, the cover insulating layer 33 may have a boundary with the insulating film and the coil pattern to thereby be distinguished therefrom.

A thickness "Tc" of the cover insulating layer 33 may be 1 to 10 μm. Since the coil part and the substrate may be insulated from the outside by the cover insulating layer having a relatively small thickness, inductance characteristics may be improved.

The cover insulating layer 33 may be formed of a polymer insulating material, for example, a phenylene-based polymer, but is not limited thereto.

One end portion of the first coil part formed on one surface of the substrate 20 may be exposed to one end surface of the body 50 in the length (L) direction thereof, and one end portion of the second coil part 42 formed on the opposing surface of the substrate 20 may be exposed to the opposing end surface of the body 50 in the length (L) direction thereof.

However, the respective end portions of each of the first and second coil parts 41 and 42 are not limited to being exposed as described above, but may instead be exposed to other surfaces so that they are each exposed to at least one surface of the body 50.

The first and second external electrodes 81 and 82 may be formed on the outer portion of the body 50, to be electrically connected to the first and second coil parts 41 and 42, respectively. For example, where the first and second coil parts are respectively exposed to opposing ends surfaces of the body 50, the first and second external electrodes can be on the respective end surfaces of the body 50.

Hereinafter, a manufacturing method of a thin film inductor according to the present disclosure will be described.

FIGS. 4A through 4D are views sequentially illustrating a manufacturing method of a thin film inductor according to an exemplary embodiment in the present disclosure.

Referring to FIGS. 4A through 4D, the manufacturing method of a thin film inductor according to the exemplary embodiment in the present disclosure may include patterning a first plating layer 25 on a substrate 20. An insulating film 31 may be patterned so that the first plating layer is exposed. A second plating layer 40 may be formed between the patterned insulating films by performing the plating based on the first plating layer, to thereby obtain coil patterns comprising first and second plating layers 25 and 40. The second plating layer 40 may be formed such that the thickness of the coil patterns, made up of first and second plating layers 25 and 40, may be smaller than the thickness of the insulating films 31. A body 50 may be formed by stacking magnetic sheets above and below the substrate on which the insulating film and the first and second plating layers are formed.

Figure 4A:
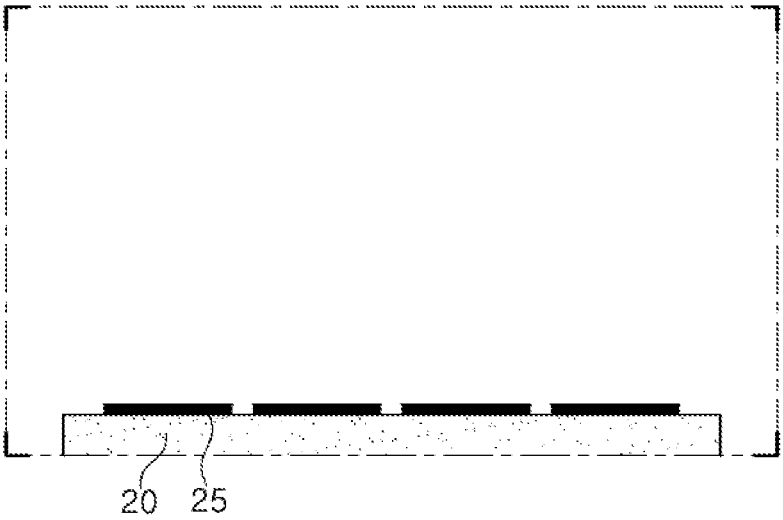
FIGS. 4A through 4D are views sequentially illustrating a manufacturing method of a thin film inductor according to an exemplary embodiment in the present disclosure.

Referring to FIG. 4A, the substrate 20 may be prepared, and the first plating layer 25 may be patterned on the substrate 20.

A via hole may be formed in the substrate 20 using a mechanical drill or laser drill, but is not necessarily limited thereto. The laser drill may be, for example, a $CO_2$ laser drill or a YAG laser drill.

In detail, the first plating layer 25 may be formed by performing an electroless plating method or sputtering method on the substrate 20 to forma conductive layer, forming a resist pattern 71, etching the resist pattern 71 for patterning, and delaminating the resist pattern 71.

The width of the first plating layer 25 may be 10 to 150 μm, but is not necessarily limited thereto.

Figure 4B:
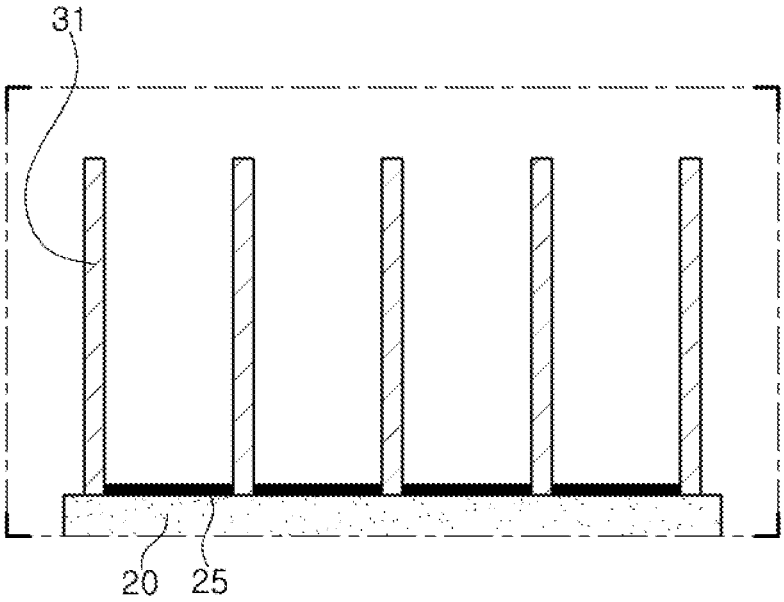

Referring to FIG. 4B, the insulating film 31, patterned so as to expose the first plating layer, may be formed on the substrate 20.

The insulating film 31 may be formed on portions of the substrate 20 that are exposed between the first plating layers 25 to thereby be patterned.

The width of the insulating film 31 may be 1 to 20 μm, and a thickness thereof is not particularly limited but may be determined depending on a required thickness of the second plating layer 40 to be formed by an isotropic plating method.

The formation method for the insulating film 31 is not particularly limited, but the insulating film 31 may be formed by a general formation method of a circuit.

The insulating film 31 may be formed of a material having insulating properties. For example, a filler may be used, along with a polymer, photo-curable acrylate, or thermo-curable epoxy, or the like, in addition to the filler, but the material of the insulating film 31 is not limited thereto.

The insulating film 31 may be formed of a photo resist (PR) using an exposure and development method.

Since the insulating film 31 may serve as a dam for an isotropic plating for forming the second plating layer 40, having a thickness of 200 μm, the insulating film 31 may be formed to have a thickness of 200 μm or more.

Figure 4C:
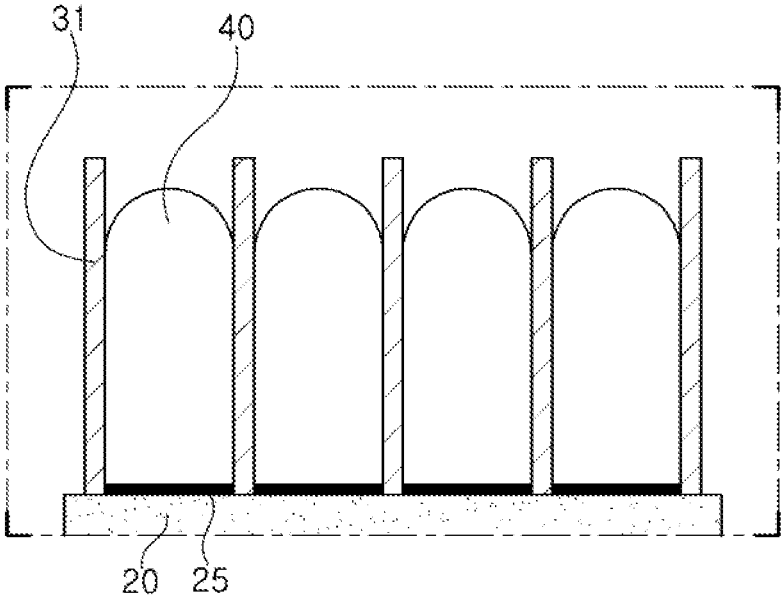

Referring to FIG. 4C, the second plating layer 40 may be formed by performing the plating based on the first plating layer 25 between the patterned insulating films 31, thereby obtaining the coil patterns made up of first and second plating layers 25 and 40.

The second plating layer 40 may have a thickness of 200 μm or more. The coil pattern may thus also have a thickness of 200 μm or more.

The second plating layer 40 may have a high AR of 3.0 or more.

The second plating layer 40 may be formed between the patterned insulating films 31 by the isotropic plating method, such that an exposure limitation depending on a thickness of a plating resist may be overcome and the second plating layer 40 may be implemented to have a total thickness of 200 μm or more.

Figure 4D:
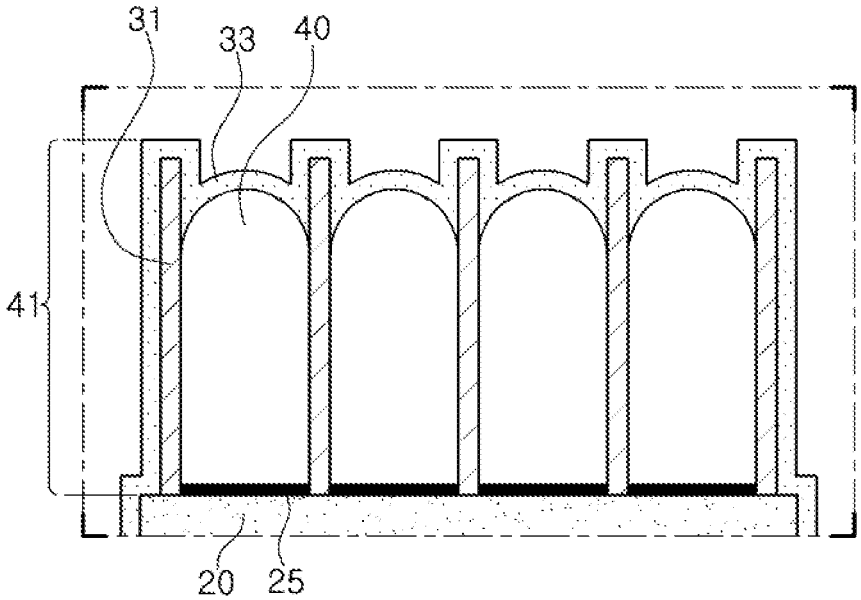

Referring to FIG. 4D, a cover insulating layer 33 may be formed on the insulating film 31 and the second plating layer 40.

The cover insulating layer 33 and the insulating film 31 may be formed of different materials from each other.

The cover insulating layer 33 may be formed of a polymer insulating material, for example, a phenylene-based polymer, but is not limited thereto.

Since the cover insulating layer 33 is formed on the patterned insulating film 31 and the coil pattern, the material and shape of the cover insulating layer 33 may be different from those of the insulating film 31, such that the cover insulating layer 33 may have a boundary with the insulating film 31 and the second plating layer 40 to thereby be distinguished therefrom.

The cover insulating layer 33 may be formed by a method such as a screen printing method, a spray application method, or the like, a chemical vapor deposition (CVD) method, or a dipping method using a low-viscosity polymer coating solution, but is not necessarily limited thereto.

Figure 5:
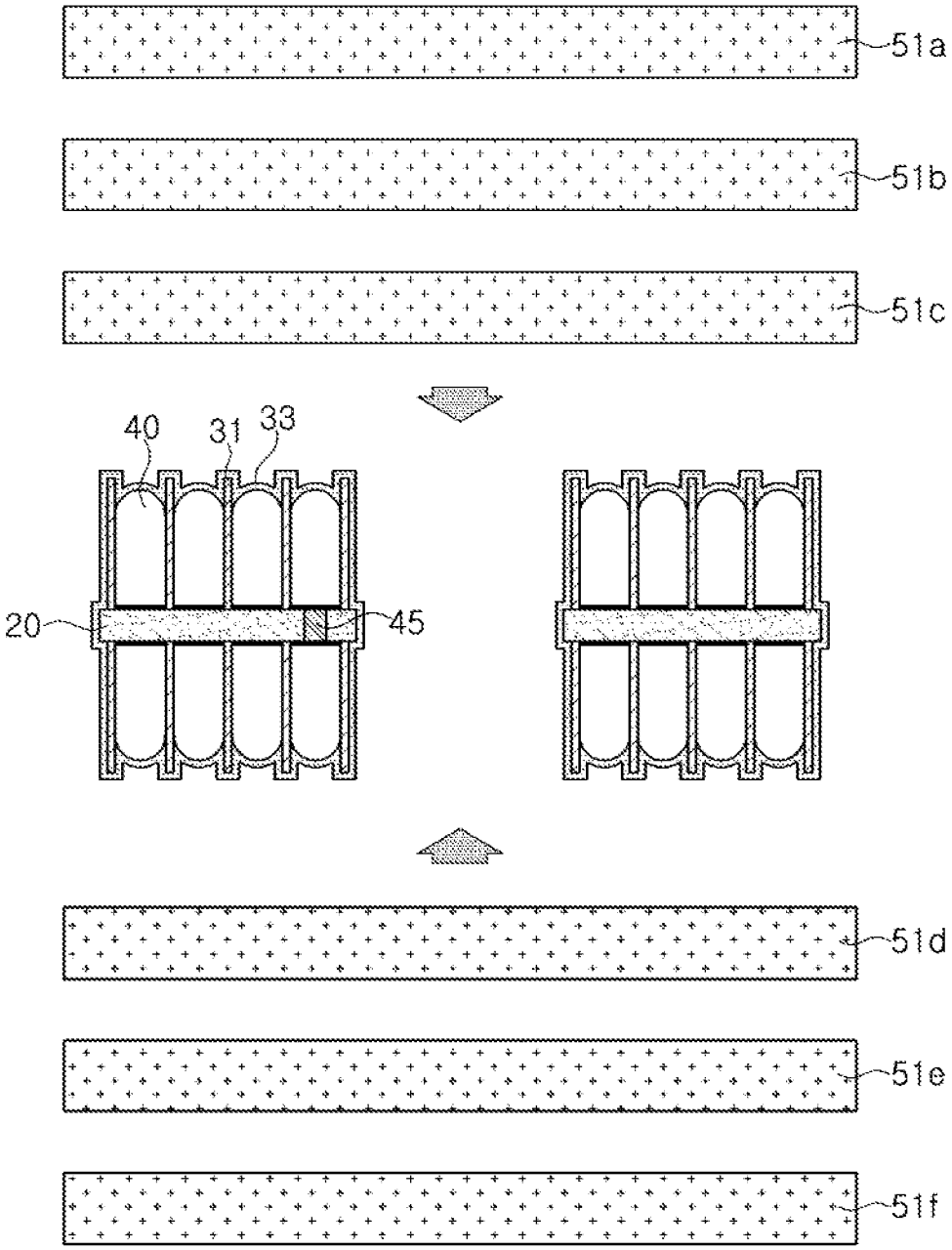
FIG. 5 is a schematic process cross-sectional view for describing a formation method of a body according to the exemplary embodiment in the present disclosure.

FIG. 5 is a schematic process cross-sectional view for describing a formation method of the body 50 according to the exemplary embodiment in the present disclosure.

Referring to FIG. 5, the body 50 may be formed by stacking magnetic sheets 51*a*, 51*b*, 51*c*, 51*d*, 51*e*, and 51*f* above and below the substrate 20 on which the first and second coil parts 41 and 42 are formed, respectively.

Here, the magnetic sheets may be filled in the space between the patterned insulating films 31 on the coil pattern.

The magnetic sheets 51*a*, 51*b*, 51*c*, 51*d*, 51*e*, and 51*f* may be manufactured in a sheet form by mixing a magnetic material, for example, a metal magnetic powder, with an organic material such as a thermosetting resin, and the like, to prepare slurry, applying the slurry on a carrier film using a doctor blade method, and drying the applied slurry.

The body 50 may be formed by stacking the plurality of magnetic sheets 51*a*, 51*b*, 51*c*, 51*d*, 51*e*, and 51*f* and then compressing and curing the stacked magnetic sheets using a lamination method or isostatic pressing method.

Besides the description of features described above, an overlapping description of features are omitted.

As set forth above, according to exemplary embodiments in the present disclosure, the coil part may be formed so that the coil part is not bent but is formed in a coil shape, such that there may be fewer defects in which the insulating layer is not formed in the space between the coil patterns. In addition, the coil pattern may be formed in a structure with a high AR while having a uniform thickness, thereby increasing the cross-sectional area of the coil part and improving direct current resistance (Rdc) characteristics.

While exemplary embodiments have been shown and described above, it will be apparent to those skilled in the art that modifications and variations could be made without departing from the scope of the present invention, as defined by the appended claims.

What is claimed is:

1. A thin film inductor comprising:

a body including a coil part disposed therein, wherein the coil part includes:

a patterned insulating film disposed on a substrate; and a coil pattern disposed between portions of the patterned insulating film, the coil pattern including a first plating layer disposed on the substrate and a second plating layer disposed on the first plating layer, wherein the body further includes a cover insulating layer enclosing the coil part, the cover insulating layer comprising a polymer insulating material, wherein the coil pattern has a lower height, in a thickness direction, than the patterned insulating film, and wherein the first plating layer directly contacts a side surface of the patterned insulating film.

2. The thin film inductor of claim 1, further comprising a conductive via disposed in the substrate, the conductive via having upper and lower surfaces that are respectively exposed from upper and lower surfaces of the substrate.

3. The thin film inductor of claim 1, wherein the cover insulating layer and the patterned insulating film are composed of different materials from each other.

4. The thin film inductor of claim 1, wherein the body is composed of a magnetic material, the magnetic material being filled in a space between portions of the patterned insulating film and above the coil pattern.

5. The thin film inductor of claim 1, wherein the patterned insulating film has a thickness of 200 μm or more.

6. The thin film inductor of claim 1, wherein the coil pattern has a thickness of 200 μm or more.

7. The thin film inductor of claim 1, wherein the coil pattern has an aspect ratio of 3.0 or more.

* * * * *